US010385596B2

(12) United States Patent
Nakanishi et al.

(10) Patent No.: US 10,385,596 B2
(45) Date of Patent: Aug. 20, 2019

(54) LID LOCK DEVICE

(71) Applicant: AISIN SEIKI KABUSHIKI KAISHA, Kariya-shi (JP)

(72) Inventors: Eisuke Nakanishi, Kariya (JP); Toshihiro Kitamura, Nagoya (JP); Takumi Niwa, Kariya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 554 days.

(21) Appl. No.: 15/070,603

(22) Filed: Mar. 15, 2016

(65) Prior Publication Data

US 2016/0290017 A1 Oct. 6, 2016

(30) Foreign Application Priority Data

Mar. 30, 2015 (JP) ..... 2015-069883

(51) Int. Cl.
*E05B 81/18* (2014.01)
*E05B 77/34* (2014.01)
(Continued)

(52) U.S. Cl.
CPC ..... *E05B 83/34* (2013.01); *E05B 77/34* (2013.01); *E05B 81/06* (2013.01); *E05B 81/18* (2013.01);
(Continued)

(58) Field of Classification Search
CPC ..... E05B 81/06; E05B 81/18; E05B 81/34; E05B 83/28; E05B 83/34;
(Continued)

(56) References Cited

U.S. PATENT DOCUMENTS 2,486,460 A * 11/1949 Bonenberger ..... E05B 65/0003 292/34
3,322,451 A * 5/1967 Bredemus ..... E05B 65/06 292/137
(Continued)

FOREIGN PATENT DOCUMENTS

DE 102010040522 A1 * 3/2012 ..... B60L 11/1818
EP 2082914 A1 * 7/2009 ..... B60K 15/05
(Continued)

*Primary Examiner* — Carlos Lugo
(74) *Attorney, Agent, or Firm* — Oblon, McClelland, Maier & Neustadt, L.L.P.

(57) ABSTRACT

A lid lock device attached to a vehicle includes: a housing; and a lock member which includes a main shaft portion, an intermediate portion extending from the main shaft portion, and a tip end portion extending from the intermediate portion and thinner than the main shaft portion, which is provided in the housing to be movable in an axial direction, and in which at least the tip end portion and the intermediate portion are disposed outside the housing, wherein the intermediate portion is configured to be narrow from the main shaft portion side toward the tip end portion side and the intermediate portion is provided with at least one inclination surface inclining downward in a direction toward the outside of the vehicle in a width direction of the vehicle and inclining to a central axis in a direction toward the tip end portion.

7 Claims, 9 Drawing Sheets

(51) Int. Cl.

| | |
|---|---|
| ***E05B 83/34*** | (2014.01) |
| ***E05B 81/06*** | (2014.01) |
| ***E05B 81/34*** | (2014.01) |
| ***E05C 1/08*** | (2006.01) |

(52) U.S. Cl.
CPC ..... *E05B 81/34* (2013.01); *E05C 1/08* (2013.01); *Y10T 292/1021* (2015.04); *Y10T 292/307* (2015.04)

(58) Field of Classification Search
CPC ..... Y10T 292/1021; Y10T 292/307; B60K 15/05; B60K 2015/0515; B60K 2015/0561; B60K 2015/0584
USPC ..... 292/137, 144; 296/97.22
See application file for complete search history.

(56) References Cited

U.S. PATENT DOCUMENTS 4,474,393 A * 10/1984 Kimura ..... B60K 15/05 292/171
4,525,004 A * 6/1985 Tanaka ..... B60K 15/05 292/171
5,080,421 A * 1/1992 Otowa ..... B60K 15/03504 296/97.22
5,222,774 A * 6/1993 Fukumoto ..... E05B 81/14 292/144
5,626,374 A * 5/1997 Kim ..... E05C 1/145 292/137
5,884,958 A * 3/1999 Oddenino ..... B60K 15/04 296/97.22
6,050,623 A * 4/2000 Martus ..... E05B 47/026 292/171
6,120,069 A * 9/2000 Taranto ..... E05B 83/30 292/166
6,926,331 B2 * 8/2005 Cho ..... E05B 83/30 292/DIG. 41
8,182,000 B2 * 5/2012 Mitchell, Jr. ..... B60R 7/06 292/19
8,622,442 B2 * 1/2014 Imatomi ..... B60K 15/05 292/143
8,807,603 B2 * 8/2014 Niwa ..... E05B 81/18 292/142
2015/0115618 A1 4/2015 Ito et al.
2015/0115619 A1 4/2015 Ito et al.
2015/0115620 A1 4/2015 Ito et al.
2015/0115621 A1 4/2015 Kitamura et al.

FOREIGN PATENT DOCUMENTS

EP 2182148 A2 * 5/2010 ..... E05B 81/06
JP 2008-303636 12/2008
WO WO 2015/046550 A1 4/2015

* cited by examiner

LID LOCK DEVICE

CROSS REFERENCE TO RELATED APPLICATIONS

This application is based on and claims priority under 35 U.S.C. § 119 to Japanese Patent Application 2015-069883, filed on Mar. 30, 2015, the entire contents of which are incorporated herein by reference.

TECHNICAL FIELD

This disclosure relates to a lid lock device which fixes a fuel lid of a vehicle at a closed position.

BACKGROUND DISCUSSION

JP 2008-303636A (Reference 1) discloses a technique of a lid lock device.

Reference 1 discloses a lid lock device including a housing, a lock member (also called a rod or a mover), and a drive mechanism which moves the lock member. At least a terminal end portion of the lock member is accommodated in the housing, and at least a tip end portion of the lock member protrudes from the housing. The tip end portion of the lock member engages with a fuel lid when the fuel lid is at a closed position. The lock member moves between a first position where the tip end portion and the fuel lid engage with each other and a second position where the tip end portion is separated from the fuel lid.

Incidentally, components such as electrical components and gear wheels of a motor and the like are accommodated inside a housing, and when water or dust invades the housing, there is a possibility that the components become broken down or cause trouble. Therefore, in order to prevent water or dust from invading the inside of the housing, a sealing member is provided between a lock member and an opening portion of the housing. However, when water, dust, or the like enters a gap between the lock member and the opening portion of the housing, water or dust gathers in the gap, and thus, there is a case where the lock member becomes stuck and does not move. For example, in a case of water, when water freezes, the lock member becomes stuck. In a case of dust, dust is interposed between the lock member and the opening portion of the housing, and thus, the lock member becomes stuck.

SUMMARY

Thus, a need exists for a lid lock device which is not susceptible to the drawback mentioned above.

(1) A lid lock device according to an aspect of this disclosure is attached to a vehicle and includes a housing, and a lock member which includes a main shaft portion, an intermediate portion extending from the main shaft portion and a tip end portion being a portion that extends from the intermediate portion and being thinner than the main shaft portion, which is provided in the housing so as to be movable in an axial direction, and in which at least the tip end portion and the intermediate portion are disposed outside the housing in which the intermediate portion is configured to be narrow from the main shaft portion side toward the tip end portion side and the intermediate portion is provided with at least one inclination surface which inclines downward in a direction toward the outside of the vehicle in a width direction of the vehicle and inclines to a central axis in a direction toward the tip end portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

Figure 1:
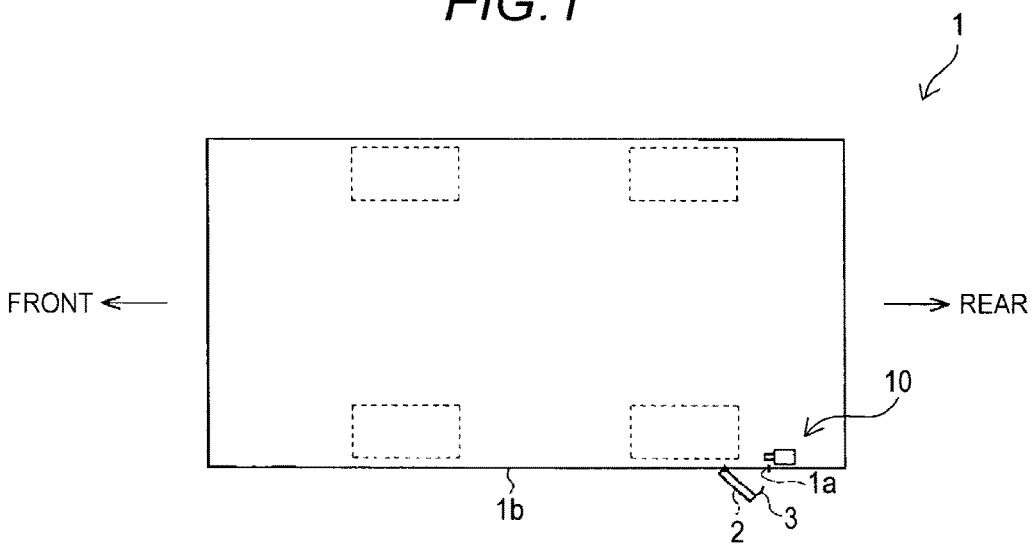
FIG. 1 is a planar view of a vehicle which is equipped with a lid lock device.

A lid lock device will be described with reference to FIGS. 1 to 9C.

When describing a disposition relationship of each portion in a lid lock device 10, description will be given based on a state where the lid lock device 10 is attached to a vehicle 1. In other words, a forward-rearward direction and a vertical direction in the following description are considered to be equal to the forward-rearward direction of the vehicle and the vertical direction of the vehicle.

A fuel lid 2 closes a fueling opening portion 1*a* which is provided in the vehicle 1. The fuel lid 2 is attached in the vicinity of the fueling opening portion 1*a* in a rotatable manner. A position of the fuel lid 2 when the fuel lid 2 closes the fueling opening portion 1*a* is referred to as "closed position", and a position of the fuel lid 2 when the fuel lid 2 is in an open state while being separated from the fueling opening portion 1*a* is referred to as "open position" (refer to FIG. 1).

The fuel lid 2 is urged by an urging member so as to be separated from the fueling opening portion 1*a*. Therefore, when no external force is added to the fuel lid 2, the urging member moves the fuel lid 2 to the open position. When the fuel lid 2 is disposed at the closed position, the fuel lid 2 is fixed by the lid lock device 10.

The fuel lid 2 is provided with an engagement portion 3 (refer to FIG. 1) which engages with a lock member 20 (refer to the description below) of the lid lock device 10. For example, the engagement portion 3 is provided with an engagement recess portion 4 (refer to FIGS. 9A to 9C) or an insertion hole through which the lock member 20 is inserted.

Figure 9A:
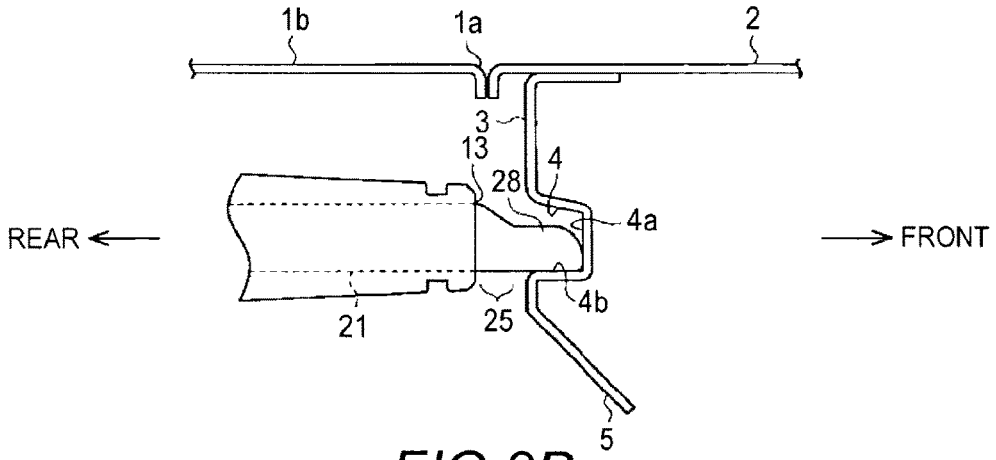
FIGS. 9A to 9C are planar views illustrating operations of the lid lock device.

In addition, the engagement portion 3 is provided with a portion with which the lock member 20 comes into contact (hereinafter, will be referred to as "contact portion 5". Refer to FIG. 9C) when the fuel lid 2 rotates from the open position toward the closed position. The contact portion 5 extends from an end edge of the engagement portion 3, and extends inward in a vehicle width direction and forward when the fuel lid 2 is in a closed state (refer to FIG. 9A). As the fuel lid 2 rotates from the open position to the closed position, the contact portion 5 thrusts the lock member 20 into a housing 11 (refer to FIG. 9C).

Figure 2:
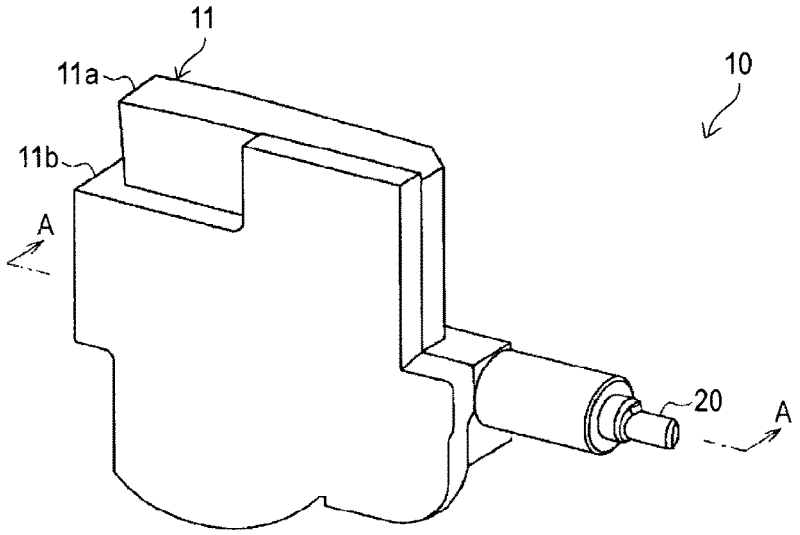
FIG. 2 is a perspective view of the lid lock device.
Figure 3:
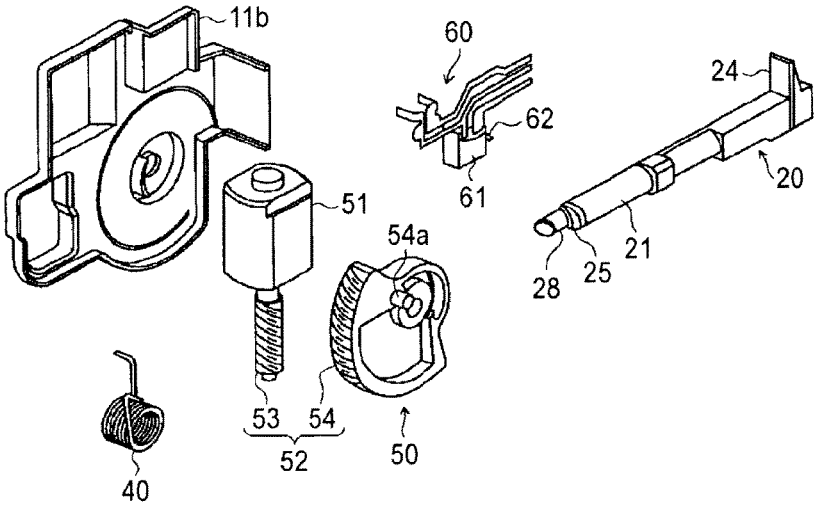
FIG. 3 is an exploded perspective view of the lid lock device.
Figure 4:
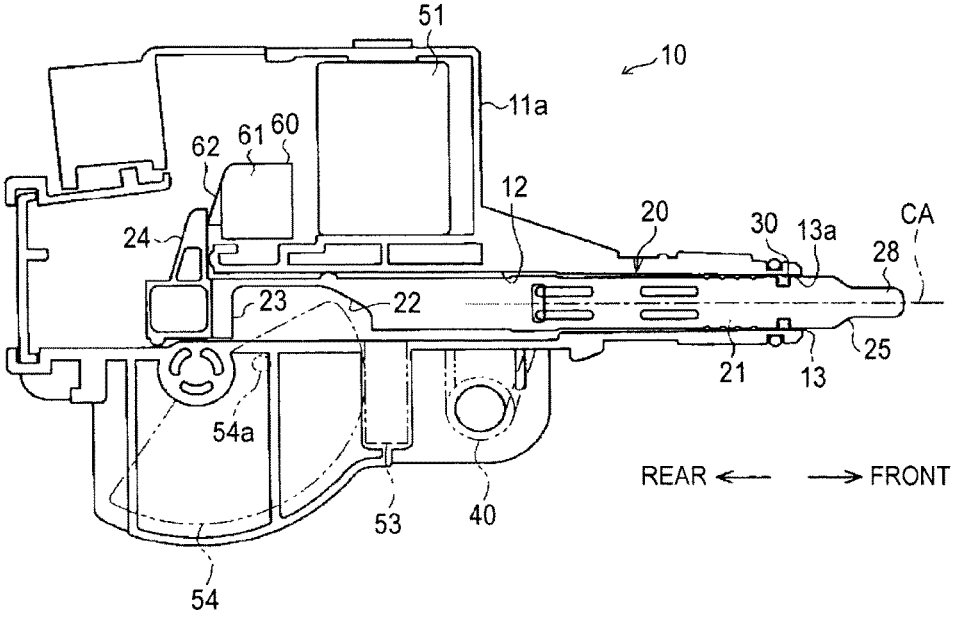
FIG. 4 is a cross-sectional view of the lid lock device taken along line IV-IV in FIG. 2.

FIG. 2 is a perspective view of the lid lock device 10. FIG. 3 is an exploded perspective view of the lid lock device 10. In FIG. 3, a first housing 11*a* is omitted. FIG. 4 is a cross-sectional view of the lid lock device 10.

As illustrated in FIGS. 2 to 4, the lid lock device 10 includes the lock member 20 which engages with the engagement portion 3 of the fuel lid 2, the housing 11 which supports the lock member 20, and a drive mechanism 50 which moves the lock member 20. The housing 11 is configured to include the first housing 11*a* and a second housing 11*b*. A rear portion of the lock member 20 and the drive mechanism 50 are accommodated in an accommodation space which is configured to be located between the first housing 11*a* and the second housing 11*b*. The first housing 11*a* is provided with a guide portion 12 which supports the lock member 20 in a movable manner. In front of the guide portion 12, there is provided an opening portion 13 through which the lock member 20 is inserted. The lock member 20 moves forward and rearward along the axial direction (a direction along a central axis CA of a main shaft portion 21).

As illustrated in FIGS. 3 and 4, the drive mechanism 50 includes a motor 51, a transmission mechanism 52 which transmits power from the motor 51 to the lock member 20, and a switch 60 which operates the motor 51 or stops the motor 51 from operating. For example, the transmission mechanism 52 includes a worm gear 53 which is attached to an output axis of the motor 51, and a worm wheel 54 which meshes with the worm gear 53. A protrusion 54*a* which presses the lock member 20 is provided on a side surface of the worm wheel 54.

The switch 60 includes a switch main body portion 61 and a switch lever 62 which is rotatably attached to the switch main body portion 61. The switch lever 62 is urged so as to protrude from the switch main body portion 61. The switch lever 62 is disposed so as to cause a switch pressing portion 24 provided in the lock member 20 to come into contact with the switch lever 62 when the lock member 20 is disposed at the forefront position (refer to the description below). In other words, when the lock member 20 is disposed at the forefront position, the switch pressing portion 24 presses the switch lever 62. When the switch lever 62 is pressed, the switch 60 is in an ON-state. When the switch lever 62 is not pressed, the switch 60 is in an OFF-state.

As illustrated in FIG. 4, the lock member 20 includes the main shaft portion 21, an intermediate portion 25 which extends from the main shaft portion 21 to the tip end side, and a tip end portion 28 which extends from the intermediate portion 25.

Most of the main shaft portion 21 is accommodated inside the housing 11. A front end portion 21*a* of the main shaft portion 21 enters the housing 11 or exits from the housing 11 in response to a movement of the lock member 20 (refer to FIGS. 9A to 9C). A sealing member 30 which seals a gap between a circumferential surface of the main shaft portion 21 and an inner circumferential surface 13*a* of the opening portion 13 is attached to a portion at the rear from the front end portion 21*a* of the main shaft portion 21. A cross-sectional structure of the sealing member 30 has an X-shape, for example.

The above-described switch pressing portion 24 protrudes from a rear portion of the main shaft portion 21 of the lock member 20. The switch pressing portion 24 is provided at a position where the switch pressing portion 24 can come into contact with the switch lever 62 of the switch 60. A body portion of the main shaft portion 21 of the lock member 20 is provided with an accommodation recess portion 22 in which the protrusion 54*a* of the worm wheel 54 can be accommodated. A rear portion of the accommodation recess portion 22 is provided with a contact surface 23 with which the protrusion 54*a* comes into contact. When the protrusion 54*a* comes into contact with the contact surface 23 of the accommodation recess portion 22 and the worm wheel 54 rotates, the protrusion 54*a* presses the contact surface 23. Therefore, the lock member 20 moves rearward.

The lock member 20 is urged forward by a spring 40.

When the protrusion 54*a* of the worm wheel 54 is not in contact with the contact surface 23 of the accommodation recess portion 22 of the lock member 20, the lock member 20 moves forward due to urging force of the spring 40. The lock member 20 moves between a first position (hereinafter, will be referred to as "forefront position") and a second position (hereinafter, will be referred to as "rearmost position". Refer to FIG. 9A). A movement path of the lock member 20 temporarily passes beyond the rearmost position (refer to FIG. 9B). The forefront position indicates a position of the lock member 20 when the tip end portion 28 is farthest away from the opening portion 13 of the housing 11 within a movement range of the lock member 20 in the forward-rearward direction. The rearmost position indicates a position of the lock member 20 when the tip end portion 28 approaches the opening portion 13 of the housing 11 within the movement range of the lock member 20 in the forward-rearward direction.

The tip end portion 28 and the intermediate portion 25 are disposed outside the housing 11. Preferably, when the lock member 20 is disposed at the rearmost position (refer to the two-dot chain line in FIG. 6), the border between the main shaft portion 21 and the intermediate portion 25 is positioned at the opening portion 13 of the housing 11.

The tip end portion 28 is thinner than a portion on the tip end side of the main shaft portion 21 (that is, the front end portion 21*a*). Specifically, the body portion of the tip end portion 28 is a column, and the diameter of the body portion of the tip end portion 28 is smaller than the diameter of the front end portion 21*a* of the main shaft portion 21. A tip end surface 28*a* of the tip end portion 28 inclines rearward in a direction toward the outside.

Figure 6:
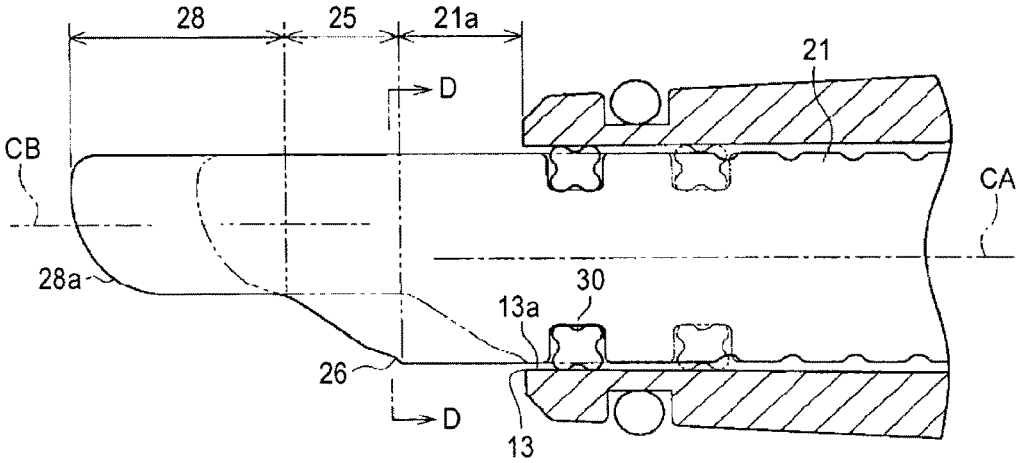
FIG. 6 is a partial cross-sectional view of the lid lock device taken along line VI-VI in FIG. 5.

In addition, the tip end portion 28 is eccentric with respect to the main shaft portion 21 (refer to FIG. 6). Specifically, a central axis CB of the tip end portion 28 is positioned on an inner side in the vehicle width direction with respect to the central axis CA of the main shaft portion 21 (in the present embodiment, the central axis CA indicates the central axis CA of the front end portion 21*a* having a columnar structure) (refer to FIGS. 6 and 7).

The intermediate portion 25 is a portion extending from the main shaft portion 21 and is a portion which is positioned between the main shaft portion 21 and the tip end portion 28. The intermediate portion 25 is narrow from the main shaft portion 21 toward the tip end portion 28.

All cross sections (cross sections perpendicular to the central axis CA including a certain point on a line taken along the central axis CA of the main shaft portion 21 in the intermediate portion 25) of the intermediate portion 25 are smaller than a cross section of the front end portion 21*a* of the main shaft portion 21 and are greater than a cross section of the thickest portion in the tip end portion 28.

The structure of the intermediate portion 25 of the lock member 20 will be described with reference to FIGS. 5 to 8.

Figure 7:
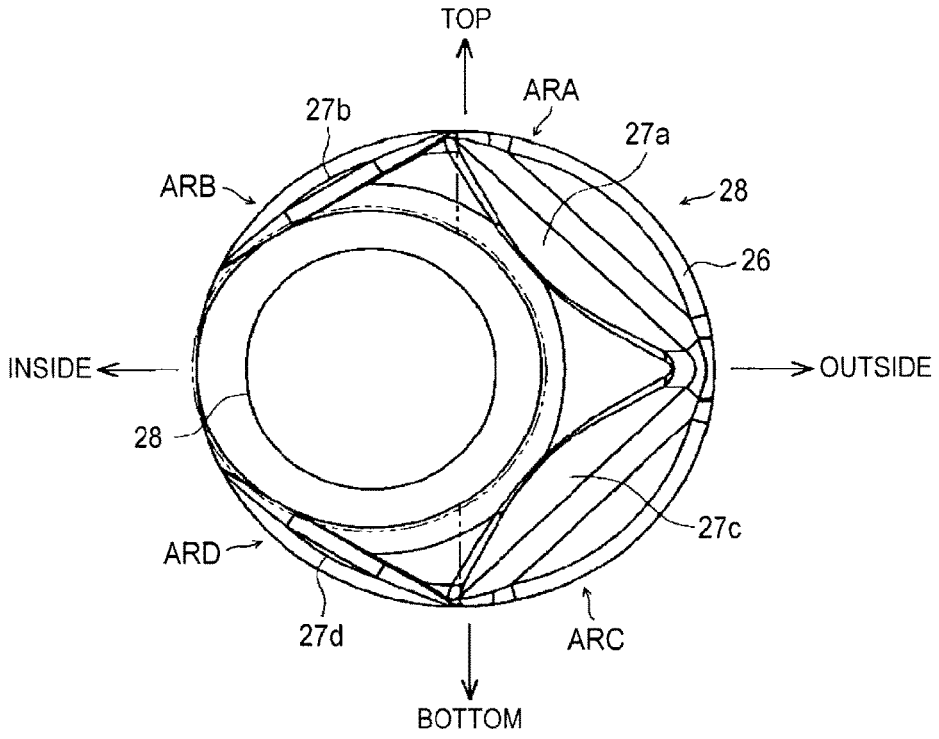
FIG. 7 is a front view of a lock member which is viewed in a direction of Arrow C in FIG. 5.

The intermediate portion 25 is divided into two areas in a lateral direction (the vehicle width direction) and is divided into two areas in the vertical direction. In a front view (refer to FIG. 7), the area on the upper right side of the intermediate portion 25 (that is, the area on the outer side and the upper side in the vehicle width direction) is referred to as a first area ARA, and the area on the upper left side of the intermediate portion 25 (that is, the area on the inner side and the upper side in the vehicle width direction) is referred to as a second area ARB. In addition, the area on the lower right side of the intermediate portion 25 (that is, the area on the outer side and the lower side in the vehicle width direction) is referred to as a third area ARC, and the area on the lower left side of the intermediate portion 25 (that is, the area on the inner side and the lower side in the vehicle width direction) is referred to as a fourth area ARD. In FIG. 7, the borders between the areas and the borders between each area and the tip end portion 28 are indicated by the two-dot chain line. The same indication is also applied to those in FIG. 12.

Figure 5:
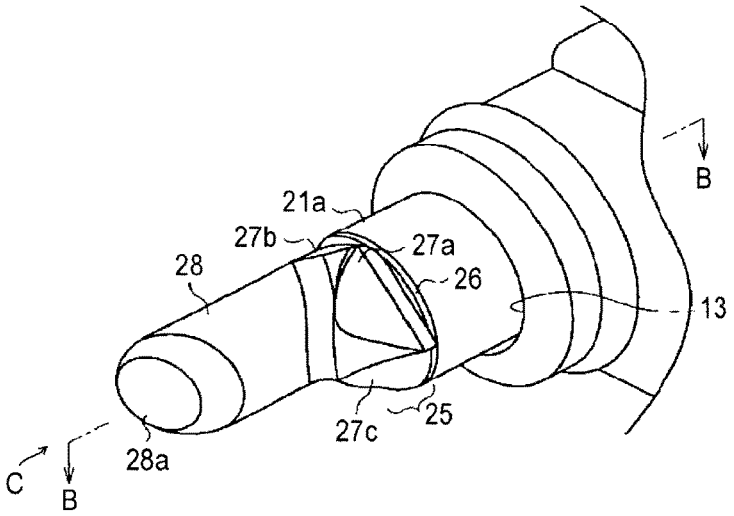
FIG. 5 is a perspective view of a tip end portion of the lid lock device according to a first embodiment.

As illustrated in FIGS. 5 and 7, in the intermediate portion 25, at least the first area ARA is provided with an inclination surface (hereinafter, will be referred to as "first inclination surface 27*a*"). The first inclination surface 27*a* has a flat structure. The first inclination surface 27*a* inclines downward in a direction toward the outside in the vehicle width direction and inclines to the central axis CA in a direction toward the tip end portion 28. The first inclination surface 27*a* provided in the first area ARA causes water, dust, or muddy water to flow downward or forward, or to be bounced forward or outward in a case where water, dust, or muddy water falls onto the intermediate portion 25 of the lock member 20 (hereinafter, will be referred to as "flow change operation of water or the like"). Accordingly, water, dust, or muddy water is prevented from moving toward the main shaft portion 21 along the surface of the intermediate portion 25.

Figure 8:
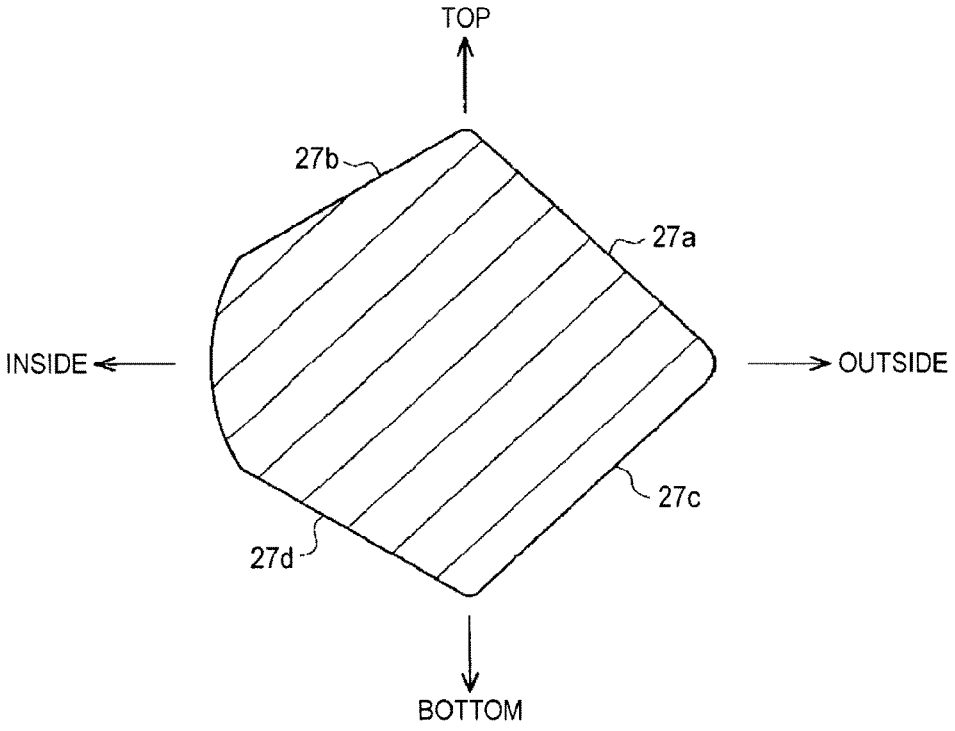
FIG. 8 is a cross-sectional view of the lock member taken along line VIII-VIII in FIG. 6.

In addition, as illustrated in FIGS. 5 and 7, in the intermediate portion 25, it is preferable that the second area ARB is provided with an inclination surface (hereinafter, will be referred to as "second inclination surface 27*b*"). The second inclination surface 27*b* has a flat structure and inclines downward in a direction toward the inside in the vehicle width direction. According to this configuration, in the inner half of the intermediate portion 25 of the lock member 20, the above-described flow change operation is activated. As illustrated in FIG. 8, the inclination angle of the second inclination surface 27*b* is smaller than that of the first inclination surface 27*a*. When the inclination angle of the second inclination surface 27*b* is significant, a notch is configured to be formed in a proximal end portion of the tip end portion 28, and thus, the strength of the tip end portion 28 is deteriorated. In order to prevent such deterioration of the strength, the inclination angle of the second inclination surface 27*b* is set to be smaller than the inclination angle of the first inclination surface 27*a*.

In addition, as illustrated in FIG. 7, in the intermediate portion 25, it is preferable that the third area ARC is provided with an inclination surface (hereinafter, will be referred to as "third inclination surface 27*c*"). It is preferable that the third inclination surface 27*c* has a vertically symmetrical structure with respect to the first inclination surface 27*a* of the first area ARA. Specifically, the third inclination surface 27*c* has a flat structure, inclines upward in a direction toward the outside in the vehicle width direction, and inclines to the central axis CA in a direction toward the tip end portion 28. The third inclination surface 27*c* conducts the flow change operation of water or the like in a case where the lock member 20 is mounted in the housing 11 in a state of being turned upside down (for example, in a case of being mounted in the lid lock device 10 which is attached to the right side of the vehicle 1, the lock member 20 is mounted in a state of being turned upside down as described above). In other words, the lock member 20 in which the first area ARA is provided with the first inclination surface 27*a* and the third area ARC is provided with the third inclination surface 27*c* can be mounted in both the lid lock device 10 which is attached to the left side and the lid lock device 10 which is attached to the right side.

In addition, as illustrated in FIG. 7, in the intermediate portion 25, it is preferable that the fourth area ARD is provided with an inclination surface (hereinafter, will be referred to as "fourth inclination surface 27*d*"). It is preferable that the fourth inclination surface 27*d* has a vertically symmetrical structure with respect to the second inclination surface 27*b*. Specifically, the fourth inclination surface 27*d* has a flat structure, and inclines upward in a direction toward the inside in the vehicle width direction. According to this configuration, in a case where the lock member 20 is mounted in the housing 11 in a state of being turned upside down, the fourth inclination surface 27*d* of the fourth area ARD conducts the above-described flow change operation of water or the like.

A step portion 26 which is high on the main shaft portion 21 side is provided on the border between the intermediate portion 25 and the main shaft portion 21 (refer to FIG. 5). In other words, the circumferential surface configured to form the main shaft portion 21 is at a position higher than the surface configured to form the intermediate portion 25 while interposing the step portion 26 therebetween. The higher position denotes that the separation distance (distance in a radial direction) from the central axis CA is significant. The step portion 26 is provided so as to wrap around the intermediate portion 25 in the circumferential direction excluding a portion (an upper portion of the intermediate portion 25). In addition, when the lock member 20 is disposed at the rearmost position, the step portion 26 is disposed in front of the opening portion 13 of the housing 11 (refer to the two-dot chain line in FIG. 6).

An operation of the lid lock device 10 will be described with reference to FIGS. 9A to 9C.

As illustrated in FIG. 9A, when the fuel lid 2 is disposed at the closed position, the lock member 20 protrudes forward due to urging force of the spring 40, the tip end portion 28 of the lock member 20 is inserted through the engagement recess portion 4 of the fuel lid 2, and the tip end surface 28*a* of the tip end portion 28 of the lock member 20 comes into contact with a bottom surface 4*a* of the engagement recess portion 4. In addition, since the fuel lid 2 is urged by the urging member so as to be oriented toward the open position, an engagement surface 4*b* (a surface oriented toward the outside in the vehicle width direction) of the engagement recess portion 4 comes into contact with a circumferential surface of the tip end portion 28 of the lock member 20. Accordingly, the fuel lid 2 is fixed at the closed position. In this case, the switch pressing portion 24 of the lock member 20 is separated from the switch lever 62 of switch 60.

Figure 9B:
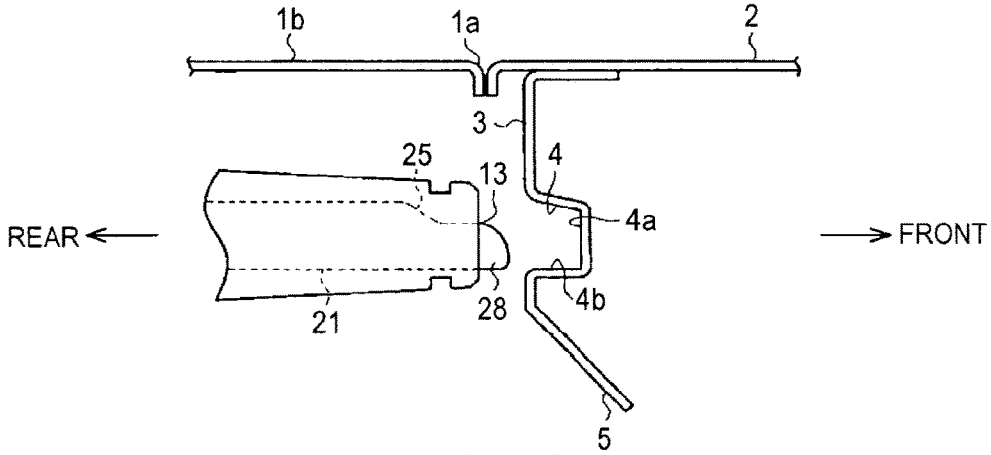
Figure 9C:
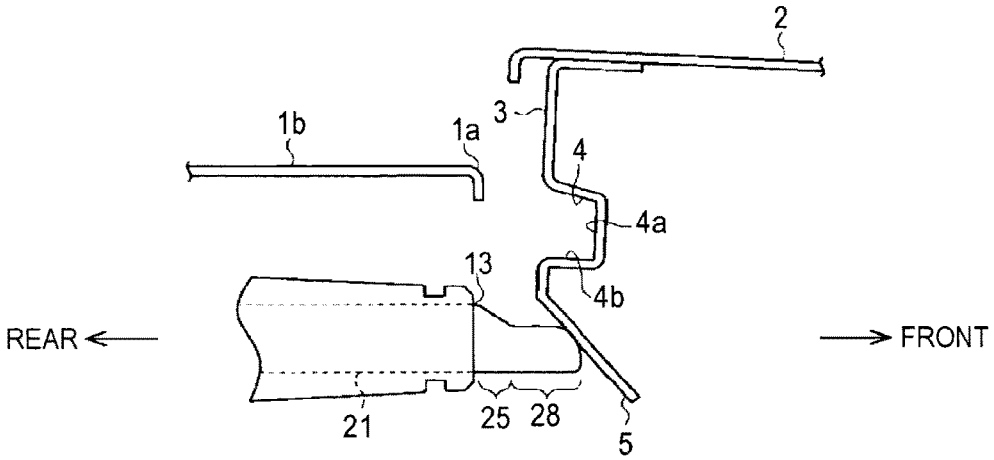

FIG. 9B is a diagram illustrating an operation of the lid lock device 10 when the fueling opening portion 1*a* of the vehicle 1 is opened. When the lid lock device 10 receives a signal for opening the fueling opening portion 1*a* of the vehicle 1, the motor 51 is in operation. In response to the operation of the motor 51, the worm gear 53 and the worm wheel 54 rotate, and the protrusion 54*a* of the worm wheel 54 comes into contact with the contact surface 23 of the accommodation recess portion 22 of the lock member 20. Then, the lock member 20 moves rearward. Therefore, the tip end portion 28 of the lock member 20 and the engagement recess portion 4 of the fuel lid 2 are disengaged from each other, and thus, the fuel lid 2 rotates toward the open position. The motor 51 reversely rotates the output axis after a predetermined time elapses (after the elapse of time longer than the time required for the fuel lid 2 to move to the open position). Consequently, the protrusion 54*a* of the worm wheel 54 is separated from the contact surface 23 of the accommodation recess portion 22 of the lock member 20. Therefore, the lock member 20 moves forward due to urging force of the spring 40. When the lock member 20 reaches the forefront position, the lock member 20 stops. In this case, the switch pressing portion 24 of the lock member 20 comes into contact with the switch lever 62. Due to this contact, the switch 60 is in the ON-state and outputs a signal indicating that the fuel lid 2 is open to a display device at the driver seat.

FIG. 9C is a diagram illustrating an operation of the lid lock device 10 when the fueling opening portion 1*a* of the vehicle 1 is closed.

When a fueling person or the like manipulates so as to rotate the fuel lid 2 toward the closed position, the contact portion 5 of the fuel lid 2 comes into contact with the tip end surface 28*a* of the lock member 20. When the fuel lid 2 rotates further toward the closed position, the lock member 20 is pressed rearward, and when the fuel lid 2 arrives immediately in front of the closed position, the tip end portion 28 of the lock member 20 is inserted through the engagement recess portion 4. Accordingly, the fuel lid 2 is fixed at the closed position by the lock member 20.

Incidentally, sometimes the lock member 20 of the lid lock device 10 becomes stuck due to water, dust, or the like. Hereinafter, description will be given regarding a reason why the lid lock device 10 becomes stuck.

When the fuel lid 2 is opened in response to an operation of the lid lock device 10, water, dust, or the like enters the inside through the fueling opening portion 1*a*, and the aforementioned substance sometimes falls onto the lid lock device 10. For example, sometimes water or muddy water adheres or dust accumulates in an upper portion of the fuel lid 2. Therefore, when the fuel lid 2 is opened, or due to vibration or the like, water, dust, or muddy water drops from the upper portion of the fuel lid 2. Consequently, water, dust, or muddy water falls onto the lock member 20.

In a case of water or muddy water, a portion of water which hits the lock member 20 invades the opening portion 13 along the lock member 20. Invasion of water is obstructed by a seal member of the lock member 20. Therefore, water is prevented from entering the housing 11. However, water sometimes gathers in a gap between a circumferential surface of the lock member 20 and the inner circumferential surface 13*a* of the opening portion 13 of the housing 11. When water gathers in the gap of the opening portion 13 in an environment where water freezes, the lock member 20 becomes stuck in the housing 11 due to freezing of water. Therefore, there is a possibility that the lock member 20 does not move, even though the motor 51 is driven.

In a case of dust, even though dust is dispersed after hitting the lock member 20, a portion thereof invades the opening portion 13 of the housing 11. For example, in a case of particles having the particle diameter in a micrometer order (for example, particles having the diameter equal to or less than 300μ), the particles sometimes ride an air current formed in the periphery of the lock member 20 and move along the lock member 20, thereby invading the opening portion 13 of the housing 11, or adhere to the lock member 20, thereby invading the opening portion 13 of the housing 11 in accordance with movement of the lock member 20. In this manner, when dust enters the opening portion 13, sand clogs the gap and the lock member 20 becomes stuck in the housing 11. Thus, there is a possibility that the lock member 20 does not move, even though the motor 51 is driven.

When the lock member 20 becomes stuck, power of the motor 51 may not be able to open the fuel lid 2, thereby causing trouble in that the lock member 20 has to be manually opened. For this reason, the lock member 20 of the present embodiment is provided with the above-described first inclination surface 27*a*, and is preferably provided with the step portion 26.

Hereinafter, operations of the first inclination surface 27*a* and the step portion 26 of the lid lock device 10 will be described.

When water falls onto the lock member 20 from above, water hits the tip end portion 28, the intermediate portion 25, and the front end portion 21*a* of the main shaft portion 21. A portion of water which hits the tip end portion 28 is bounced and drops and some portion thereof is oriented toward the intermediate portion 25 along the tip end portion 28. The water oriented toward the intermediate portion 25 moves downward along the first inclination surface 27*a* and drops. A portion of water which hits the intermediate portion 25 is bounced and drops. Some portion thereof moves downward or forward along the first inclination surface 27*a* and drops thereafter. Most of the water falling onto the intermediate portion 25 is bounced or moves downward or forward along the surface of the intermediate portion 25. However, some water moves rearward. When the water moving rearward reaches the step portion 26, the water moves downward along the step portion 26 and drops thereafter. In this manner, water which hits the tip end portion 28 and the intermediate portion 25 is prevented from moving to the main shaft portion 21 side. Accordingly, the quantity of water adhering to the front end portion 21*a* of the main shaft portion 21 is insignificant. Thus, the quantity of water invading the inside through the opening portion 13 of the housing 11 is restricted. Here, description is given regarding the operations of the first inclination surface 27*a* and the step portion 26 when water falls onto the lock member 20. However, the operations can also be applied to a case where dust or muddy water falls onto the lock member 20.

Since the quantity of water, dust, or muddy water invading the inside through the opening portion 13 of the housing 11 is restricted due to the above-described operations, water, dust, or muddy water is prevented from gathering in the gap between the inner circumferential surface 13*a* of the opening portion 13 of the housing 11 and the main shaft portion 21. As a result, the lock member 20 is prevented from becoming stuck.

The second inclination surface 27*b* of the second area ARB also exhibits an effect similar to that of the first inclination surface 27*a*.

In addition, the third inclination surface 27*c* of the third area ARC and the fourth inclination surface 27*d* of the fourth area ARD exhibit effects similar to that of the first inclination surface 27*a* in a case where the lock member 20 is turned upside down and is mounted in the housing 11.

Hereinafter, advantageous effects of the lid lock device 10 according to the present embodiment will be described.

(1) In the present embodiment, the lock member 20 includes the main shaft portion 21, the intermediate portion 25, and the tip end portion 28. The tip end portion 28 and the intermediate portion 25 are disposed outside the housing 11. The intermediate portion 25 is configured to be narrow from the main shaft portion 21 side toward the tip end portion 28 side and the intermediate portion 25 is provided with the first inclination surface 27*a*. The first inclination surface 27*a* inclines downward in a direction toward the outside in the vehicle width direction and inclines to the central axis CA in a direction toward the tip end portion 28.

According to this configuration, among water, dust, or muddy water (water including dust) which falls onto the lock member 20, water, dust, or muddy water which hits the first inclination surface 27*a* of the intermediate portion 25 collides with the first inclination surface 27*a* or moves along the first inclination surface 27*a*, thereby being guided downward or to the tip end side. Therefore, the quantity of water, dust, or muddy water which moves toward the housing 11 along the lock member 20 is insignificant. Accordingly, the lock member 20 is prevented from becoming stuck.

(2) In the present embodiment, the step portion 26 which is high on the main shaft portion 21 side is provided on the border between the intermediate portion 25 and the main shaft portion 21 of the lock member 20.

According to this configuration, among water, dust, or muddy water which falls onto the lock member 20, water, dust, or muddy water which hits the first inclination surface 27*a* of the intermediate portion 25 and moves to the housing 11 side is guided downward or to the tip end side by the step portion 26. Therefore, the quantity of water, dust, or muddy water which moves toward the housing 11 along the lock member 20 is insignificant. Accordingly, the lock member 20 is prevented from becoming stuck.

(3) In the present embodiment, when the lock member 20 is disposed at the rearmost position, the step portion 26 is disposed in front of the opening portion 13 of the housing 11.

When the lock member 20 is disposed at the rearmost position (that is, a position where the tip end portion 28 approaches the housing 11 side), if the step portion 26 enters the opening portion 13, water, dust, or muddy water gathers in the gap between the opening portion 13 and the step portion 26. Meanwhile, when the lock member 20 is disposed at the rearmost position (the second position), if the step portion 26 is positioned at a place far away from the opening portion 13, water, dust, or muddy water which falls onto a portion on the housing 11 side closer than the step portion 26 invades the opening portion 13. In regard to this matter, according to the above-described configuration, when the lock member 20 is disposed at the rearmost position, the step portion 26 is disposed in front of the opening portion 13 of the housing 11. Therefore, water, dust, or muddy water is prevented from invading the opening portion 13, and water, dust, or muddy water is prevented from gathering inside the opening portion 13.

(4) In the present embodiment, the central axis CB of the tip end portion 28 is positioned on the inner side in the vehicle width direction with respect to the central axis CA of the main shaft portion 21. Then, the first inclination surface 27*a* is disposed on the outer side in the vehicle width direction in the intermediate portion 25.

When the central axis CB of the tip end portion 28 is positioned on the inner side in the vehicle width direction with respect to the central axis CA of the main shaft portion 21, the size of the area on the outer side from the central axis CA is greater than the size of the area on the inner side from the central axis CA. Therefore, as described above, as the first inclination surface 27*a* is disposed on the outer side in the vehicle width direction in the intermediate portion 25, compared to a case where the first inclination surface 27*a* is disposed on the inner side in the vehicle width direction in the intermediate portion 25, the effect of guiding water, dust, or muddy water downward or forward is enhanced. Particularly, as illustrated in FIG. 5, in a case where the first area ARA is provided with the first inclination surface 27*a* from a circumferential edge portion of the main shaft portion 21 on the intermediate portion 25 side to a circumferential edge portion of the tip end portion 28 on the intermediate portion 25 side, compared to a case where the second area ARB is provided with the first inclination surface 27*a* from the circumferential edge portion of the main shaft portion 21 on the intermediate portion 25 side to the circumferential edge portion of the tip end portion 28 on the intermediate portion 25 side, the following effect can be achieved. In other words, according to the former configuration, the inclination surface is elongated and the size of the inclination surface increases compared to the latter configuration. Therefore, the effect of guiding water, dust, or muddy water downward or forward is enhanced.

(5) In the present embodiment, the intermediate portion 25 has the first inclination surface 27*a* and the second inclination surface 27*b* which are flat.

The first inclination surface 27*a* is provided on the upper side of the intermediate portion 25 and the outer side in the vehicle width direction (the first area ARA) when the lid lock device 10 is attached to a vehicle body 1*b*, and the first inclination surface 27*a* inclines downward in a direction toward the outside in the vehicle width direction and inclines to the direction of the central axis CA of the main shaft portion 21 in a direction toward the tip end portion 28. The second inclination surface 27*b* is provided on the upper side of the intermediate portion 25 and the inner side in the vehicle width direction (the second area ARB) when the lid lock device 10 is attached to the vehicle body 1*b*, and the second inclination surface 27*b* inclines downward in a direction toward the inside in the vehicle width direction.

According to this configuration, the lock member 20 has two inclination surfaces (the first inclination surface 27*a* and the second inclination surface 27*b*). Therefore, compared to the lock member 20 having only one inclination surface, the quantity of water, dust, or muddy water which moves toward the housing 11 along the lock member 20 is insignificant. Accordingly, the lock member 20 is further prevented from becoming stuck.

(6) In the present embodiment, the intermediate portion 25 also has the third inclination surface 27*c* and the fourth inclination surface 27*d*, in addition to the first inclination surface 27*a* and the second inclination surface 27*b*.

The third inclination surface 27*c* is provided on the lower side of the intermediate portion 25 and the outer side in the vehicle width direction (the third area ARC) when the lid lock device 10 is attached to the vehicle body 1*b*, and the third inclination surface 27*c* inclines upward in a direction toward the outside in the vehicle width direction and inclines to the central axis CA of the main shaft portion 21 in a direction toward the tip end portion 28. The fourth inclination surface 27*d* is provided on the lower side of the intermediate portion 25 and the inner side in the vehicle width direction (the fourth area ARD) when the lid lock device 10 is attached to the vehicle body 1*b*, and the fourth inclination surface 27*d* inclines upward in a direction toward the inside in the vehicle width direction.

According to this configuration, even though the lock member 20 is turned upside down in the vertical direction with respect to the housing 11, it is possible to obtain an effect similar to that described above. Accordingly, the lock member 20 having such a configuration can be applied to both the lid lock device 10 which is attached to the left side of the vehicle 1 and the lid lock device 10 which is attached to the right side of the vehicle 1. In other words, there is no need to prepare a dedicated lock member 20 for each of the lid lock device 10 on the left side and the lid lock device 10 on the right side, and thus, the initial costs of a metal mold and the like can be reduced.

Second Embodiment

A lid lock device 10 according to a second embodiment will be described with reference to FIGS. 10 to 13. In the lid lock device 10 according to the present embodiment, compared to the lid lock device 10 according to the first embodiment, the structure of an intermediate portion 25 of a lock member 20 is changed. In the lid lock device 10 according to the first embodiment, a flat inclination surface is provided in the intermediate portion 25 of the lock member 20. However, in the intermediate portion 25 according to the present embodiment, the inclination surface is curved. Hereinafter, the inclination surface will be referred to as a first curved inclination surface 27*v*.

Figure 10:
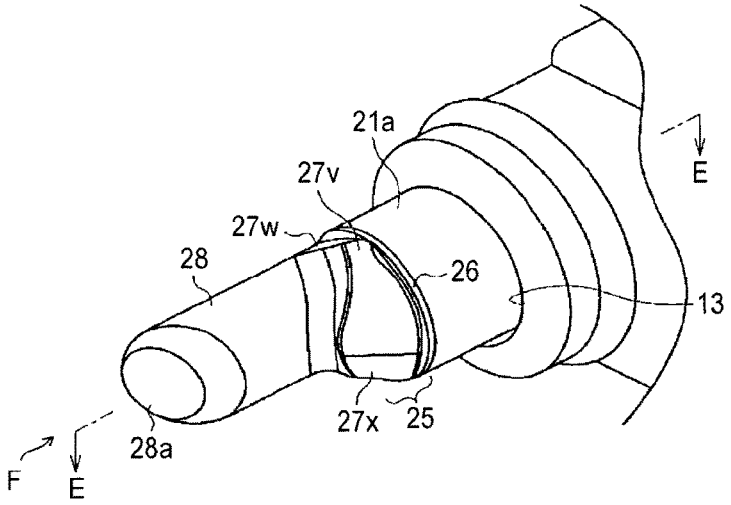
FIG. 10 is a perspective view of the tip end portion of the lid lock device according to a second embodiment.
Figure 12:
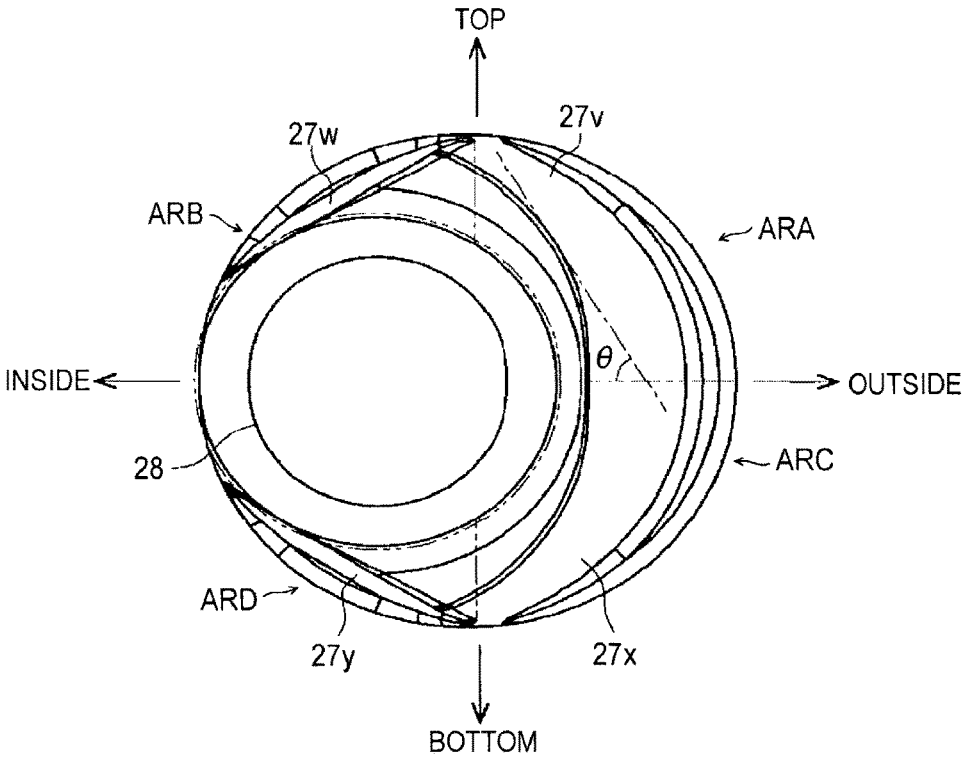
FIG. 12 is a front view of the lock member which is viewed in a direction of Arrow F in FIG. 10.
Figure 13:
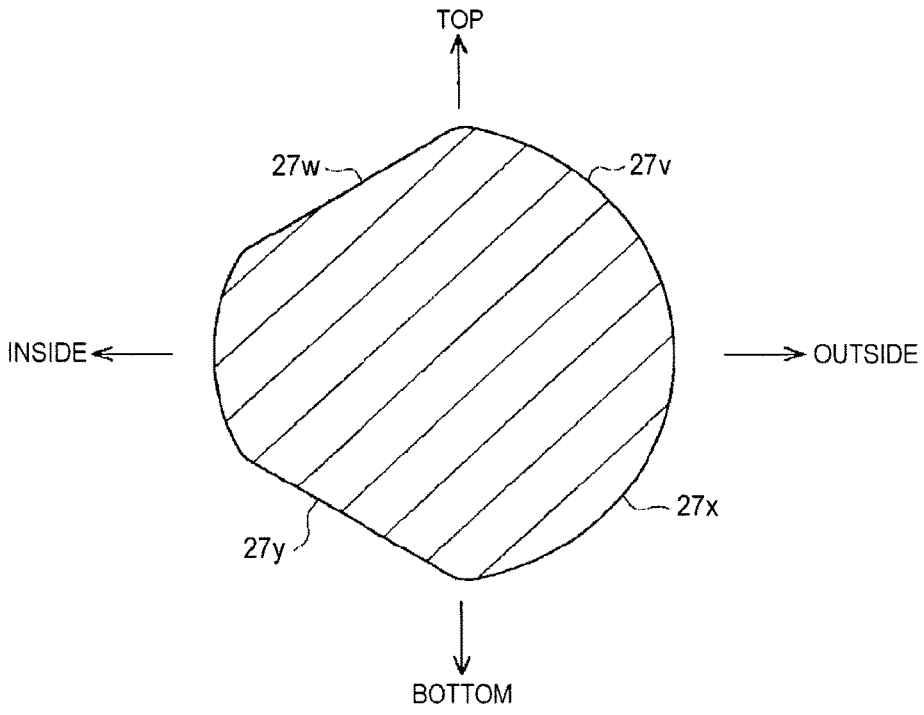
FIG. 13 is a cross-sectional view of the lock member taken along line XIII-XIII in FIG. 11.

As illustrated in FIGS. 10 and 12, in the intermediate portion 25, the first curved inclination surface 27*v* which is provided in a first area ARA inclines downward while increasing an inclination angle toward the outer side in a vehicle width direction and inclines to a central axis CA in a direction toward a tip end portion 28. Here, the inclination angle indicates an angle θ (an angle on a side of 90 degrees or lower) formed between a straight line extending vertically and laterally with respect to the central axis CA of a main shaft portion 21 and a tangent in contact with the first curved inclination surface 27*v*, in a front view of the lock member 20 (refer to FIG. 12).

In addition, as illustrated in FIGS. 10 to 13, it is preferable that a third area ARC is also provided with a second curved inclination surface 27*x* in a similar manner. It is preferable that the second curved inclination surface 27*x* of the third area ARC has a vertically symmetrical structure with respect to the first curved inclination surface 27*v* of the first area ARA. In the present embodiment, an inclination surface 27*w* (first flat inclination surface) of a second area ARB is configured to be similar to the second inclination surface 27*b* described in the first embodiment, and an inclination surface 27*y* (second flat inclination surface) of a fourth area ARD is configured to be similar to the fourth inclination surface 27*d* described in the first embodiment.

Figure 11:
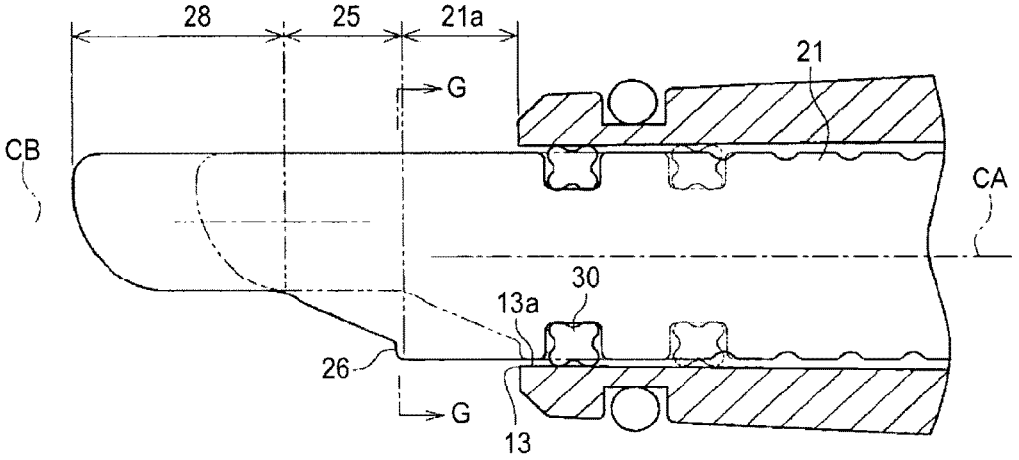
FIG. 11 is a partial cross-sectional view of the lid lock device taken along line XI-XI in FIG. 10.

Furthermore, in the lock member 20 according to the present embodiment as well, as illustrated in FIGS. 10 and 11, similar to the first embodiment, it is preferable that a step portion 26 is provided between the intermediate portion 25 and the main shaft portion 21.

Hereinafter, advantageous effects of the lid lock device 10 according to the present embodiment will be described.

(1) In the present embodiment, the intermediate portion 25 has the flat inclination surface 27*w* (the first flat inclination surface) and the first curved inclination surface 27*v*. The first curved inclination surface 27*v* is provided on an upper side and the outer side in the vehicle width direction (the first area ARA) when the lid lock device 10 is attached to a vehicle body 1*b*, and the first curved inclination surface 27*v* inclines downward in a direction toward the outside in the vehicle width direction and inclines to the central axis CA of the main shaft portion 21 in a direction toward the tip end portion 28. The inclination surface 27*w* is provided on the upper side and the inner side in the vehicle width direction (the second area ARB) when the lid lock device 10 is attached to the vehicle body 1*b*, and the inclination surface 27*w* inclines downward in a direction toward the inside in the vehicle width direction.

According to this configuration, compared to the lock member 20 having only one surface between the flat inclination surface 27*w* and the first curved inclination surface 27*v*, the quantity of water, dust, or muddy water which moves toward a housing 11 along the lock member 20 is insignificant, and thus, the lock member 20 is further prevented from becoming stuck.

(2) In the present embodiment, the intermediate portion 25 has a different flat inclination surface 27*y* (second flat inclination surface) and a different second curved inclination surface 27*x* in addition to the inclination surface 27*w* (first flat inclination surface) and the first curved inclination surface 27*v*.

The different second curved inclination surface 27*x* is provided on the lower side and the outer side in the vehicle width direction (the third area ARC) when the lid lock device 10 is attached to the vehicle body 1*b*, and the different second curved inclination surface 27*x* inclines upward in a direction toward the outside in the vehicle width direction and inclines to the central axis CA of the main shaft portion 21 in a direction toward the tip end portion 28. The inclination surface 27*y* is provided on the lower side and the inner side in the vehicle width direction (the fourth area ARD) when the lid lock device 10 is attached to the vehicle body 1*b*, and the inclination surface 27*y* inclines upward in a direction toward the inside in the vehicle width direction.

According to this configuration, even though the lock member 20 is turned upside down in a vertical direction with respect to the housing 11, it is possible to obtain an effect similar to that described above. Accordingly, the lock member 20 having such a configuration can be applied to both the lid lock device 10 which is attached to the left side of a vehicle 1 and the lid lock device 10 which is attached to the right side of the vehicle 1. In other words, there is no need to prepare a dedicated lock member 20 for each of the lid lock device 10 on the left side and the lid lock device 10 on the right side, and thus, the initial costs of a metal mold and the like can be reduced.

Other Embodiments

In the first embodiment, the first area ARA of the lock member 20 is provided with one first inclination surface 27*a*. However, the first area ARA can be provided with a plurality of the inclination surfaces. Each of the inclination surfaces has a structure similar to the first inclination surface 27*a*. For example, an intermediate portion 25 is divided into a plurality of areas from a main shaft portion 21 to a tip end portion 28, and the inclination surfaces are respectively provided in these areas. Each of the inclination surfaces inclines downward in a direction toward the outside in a vehicle width direction and inclines to a central axis CA in a direction toward the tip end portion 28. According to such a configuration as well, it is possible to obtain the effect of (1) described in the first embodiment.

In the second embodiment, the first area ARA of the lock member 20 is provided with one first curved inclination surface 27*v*. However, the first area ARA can be provided with a plurality of the curved surfaces. Each of the curved surfaces has a structure similar to the first curved inclination surface 27*v*. For example, the intermediate portion 25 is divided into a plurality of areas from the main shaft portion 21 to the tip end portion 28, and the curved surfaces are respectively provided in these areas. Each of the curved surfaces is configured to incline downward in a direction toward the outside in the vehicle width direction and to incline to the central axis CA of the main shaft portion 21 in a direction toward the tip end portion 28 side. According to such a configuration as well, it is possible to obtain the effect of (1) described in the second embodiment.

In the lock member 20 described in the first embodiment and the second embodiment, the tip end portion 28 is eccentric with respect to the main shaft portion 21. However, the above-described technique is not limited to being applied to the lock member 20 in which the tip end portion 28 is eccentric with respect to the main shaft portion 21. In other words, the first inclination surface 27*a*, the first curved inclination surface 27*v*, a step portion 26, and the like can also be formed in the lock member 20 in which the tip end portion 28 is not eccentric.

(1) A lid lock device according to an aspect of this disclosure is attached to a vehicle and includes a housing, and a lock member which includes a main shaft portion, an intermediate portion extending from the main shaft portion and a tip end portion being a portion that extends from the intermediate portion and being thinner than the main shaft portion, which is provided in the housing so as to be movable in an axial direction, and in which at least the tip end portion and the intermediate portion are disposed outside the housing in which the intermediate portion is configured to be narrow from the main shaft portion side toward the tip end portion side and the intermediate portion is provided with at least one inclination surface which inclines downward in a direction toward the outside of the vehicle in a width direction of the vehicle and inclines to a central axis in a direction toward the tip end portion.

According to this configuration, among water, dust, or muddy water (water including dust) which falls onto the lock member, water, dust, or muddy water which hits the inclination surface of the intermediate portion collides with the inclination surface or moves along the inclination surface, thereby being guided downward or to the tip end side. Therefore, the quantity of water, dust, or muddy water which moves toward the housing along the lock member is insignificant. Accordingly, the lock member is prevented from becoming stuck.

(2) In the lid lock device, a step portion which is high on the main shaft portion side may be provided on a border between the intermediate portion and the main shaft portion.

According to this configuration, among water, dust, or muddy water which falls onto the lock member, water, dust, or muddy water which hits the inclination surface of the intermediate portion and moves to the housing side is guided downward or to the tip end side by the step portion. Therefore, the quantity of water, dust, or muddy water which moves toward the housing along the lock member is insignificant. Accordingly, the lock member is prevented from becoming stuck.

(3) In the lid lock device, the lock member may move between a first position where the tip end portion is positioned farthest away from an opening portion of the housing and a second position where the tip end portion is positioned close to the opening portion of the housing, and when the lock member is disposed at the second position, the step portion may be disposed in front of the opening portion of the housing.

When the lock member is disposed at the second position where the tip end portion of the lock member approaches the housing side, if the step portion enters the opening portion, water, dust, or muddy water gathers in the gap between the opening portion and the step portion. Meanwhile, when the lock member is disposed at the second position where the tip end portion of the lock member approaches the housing side, if the step portion is positioned at a place far away from the opening portion, water, dust, or muddy water which falls onto a portion on the housing side closer than the step portion invades the opening portion. In regard to this matter, according to the above-described configuration, when the lock member is disposed at the second position where the tip end portion of the lock member approaches the housing side, the step portion is disposed in front of the opening portion of the housing. Therefore, water, dust, or muddy water is prevented from invading the opening portion, and water, dust, or muddy water is prevented from gathering inside the opening portion.

(4) In the lid lock device, the central axis of the tip end portion may be positioned on an inner side in the width direction of the vehicle with respect to the central axis of the main shaft portion, and the inclination surface may be disposed on an outer side in the vehicle width direction of the vehicle in the intermediate portion. According to this configuration, compared to a case where the inclination surface is disposed on the inner side in the vehicle width direction in the intermediate portion, the effect of guiding water, dust, or muddy water downward or forward is enhanced.

(5) In the lid lock device, the intermediate portion may include a flat first inclination surface and a flat second inclination surface which serve as the inclination surface, the first inclination surface may be provided on an upper side in a vertical direction of the vehicle and the outer side in the width direction of the vehicle, and may incline downward in a direction toward the outside of the vehicle in the width direction, and incline to the central axis of the main shaft portion in a direction toward the tip end portion, and the second inclination surface may be provided on the inner side in the vertical direction of the vehicle and in the width direction of the vehicle and inclines downward in a direction toward the inside of the vehicle in the width direction.

According to this configuration, the lock member has two inclination surfaces. Therefore, compared to the lock member having one inclination surface, the quantity of water, dust, or muddy water which moves toward the housing along the lock member is insignificant. Accordingly, the lock member is further prevented from becoming stuck.

(6) In the lid lock device, an inclination angle of the second inclination surface may be smaller than an inclination angle of the first inclination surface.

(7) In the lid lock device, the intermediate portion may have a flat third inclination surface and a flat fourth inclination surface, the third inclination surface may be provided on a lower side in the vertical direction of the vehicle and the outer side in the width direction of the vehicle, and may incline upward in a direction toward the outside of the vehicle in the width direction, and incline to the central axis of the main shaft portion in a direction toward the tip end portion, and the fourth inclination surface may be provided on the lower side in the vertical direction of the vehicle and the inner side in the width direction of the vehicle and incline upward in a direction toward the inside of the vehicle in the width direction.

According to this configuration, even though the lock member is turned upside down in the vertical direction with respect to the housing, it is possible to obtain an effect similar to that described above. Accordingly, the lock member having such a configuration can be applied to both the lid lock device which is attached to the left side of the vehicle and the lid lock device which is attached to the right side of the vehicle. In other words, there is no need to prepare dedicated lock members for each of the lid lock device on the left side and the lid lock device on the right side, and thus, the initial costs of a metal mold and the like can be reduced.

(8) In the lid lock device, the first inclination surface and the fourth inclination surface may have a vertically symmetrical structure, and the second inclination surface and the third inclination surface may have a vertically symmetrical structure.

(9) In the lid lock device, the intermediate portion may have a flat first inclination surface which is a flat surface serving as the inclination surface and a first curved inclination surface which is a curved surface, the first curved inclination surface may be provided on an upper side in a vertical direction of the vehicle and the outer side in the width direction of the vehicle, and may incline downward in a direction toward the outside of the vehicle in the width direction, and incline to the central axis of the main shaft portion in a direction toward the tip end portion, and the flat first inclination surface may be provided on the upper side in the vertical direction of the vehicle and the inner side in the width direction of the vehicle and incline downward in a direction toward the inside of the vehicle in the width direction.

According to this configuration, compared to the lock member having only one surface between the flat inclination surface and the curved inclination surface, the quantity of water, dust, or muddy water which moves toward a housing along the lock member is insignificant, and thus, the lock member is further prevented from becoming stuck.

(10) In the lid lock device, the intermediate portion may have a flat second inclination surface which is a flat surface serving as the inclination surface and a second curved inclination surface which is a curved surface, the second curved inclination surface may be provided on a lower side in the vertical direction of the vehicle and the outer side in the width direction of the vehicle, and may incline upward in a direction toward the outside of the vehicle in the width direction, and incline to the central axis of the main shaft portion in a direction toward the tip end portion, and the flat second inclination surface may be provided on the lower side in the vertical direction of the vehicle and the inner side in the width direction of the vehicle and incline upward in a direction toward the inside of the vehicle in the width direction.

According to this configuration, even though the lock member is turned upside down in the vertical direction with respect to the housing, it is possible to obtain an effect similar to that described above. Accordingly, the lock member having such a configuration can be applied to both the lid lock device which is attached to the left side of the vehicle and the lid lock device which is attached to the right side of the vehicle. In other words, there is no need to prepare dedicated lock members for each of the lid lock device on the left side and the lid lock device on the right side, and thus, the initial costs of a metal mold and the like can be reduced.

With the above-described lid lock device, a lock member is prevented from becoming stuck.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A lid lock device which is attached to a vehicle comprising:

a housing; and a lock member which includes a main shaft portion, an intermediate portion extending from the main shaft portion, and a tip end portion being a portion that extends from the intermediate portion and being thinner than the main shaft portion, the lock member is provided to the housing so as to be movable in an axial direction, and at least the tip end portion and the intermediate portion are disposed outside the housing, wherein the intermediate portion is configured to be narrow from the main shaft portion side toward the tip end portion side and the intermediate portion is provided with at least one inclination surface which inclines downward in a direction toward the outside of the vehicle in a width direction of the vehicle and inclines to a central axis in a direction toward the tip end portion, wherein the central axis of the tip end portion is positioned on an inner side in the width direction of the vehicle with respect to the central axis of the main shaft portion, wherein the inclination surface is disposed on an outer side in the vehicle width direction of the vehicle in the intermediate portion, wherein the intermediate portion has a flat first inclination surface which is a flat surface serving as the inclination surface and a first curved inclination surface which is a curved surface, wherein the first curved inclination surface is provided on an upper side in a vertical direction of the vehicle and the outer side in the width direction of the vehicle, inclines downward in a direction toward the outside of the vehicle in the width direction, and inclines to the central axis of the main shaft portion in a direction toward the tip end portion side, and wherein the flat first inclination surface is provided on the upper side in the vertical direction of the vehicle and the inner side in the width direction of the vehicle and inclines downward in a direction toward the inside of the vehicle in the width direction.

2. The lid lock device according to claim 1, wherein the main shaft portion includes a step portion which is high on a main shaft portion side provided on a border between the intermediate portion and the main shaft portion.

3. The lid lock device according to claim 2, wherein the lock member moves between a first position where the tip end portion is positioned farthest away from an opening portion of the housing and a second position where the tip end portion is positioned close to the opening portion of the housing, and when the lock member is disposed at the second position, the step portion is disposed in front of the opening portion of the housing.

4. The lid lock device according to claim 1, wherein the intermediate portion has a flat second inclination surface which is a flat surface serving as the inclination surface and a second curved inclination surface which is a curved surface, wherein the second curved inclination surface is provided on a lower side in the vertical direction of the vehicle and the outer side in the width direction of the vehicle, inclines upward in a direction toward the outside of the vehicle in the width direction, and inclines to the central axis of the main shaft portion in a direction toward the tip end portion, and wherein the flat second inclination surface is provided on the lower side in the vertical direction of the vehicle and the inner side in the width direction of the vehicle and inclines upward in a direction toward the inside of the vehicle in the width direction.

5. A lid lock device which is attached to a vehicle comprising:

a housing; and a lock member which includes a main shaft portion, an intermediate portion extending from the main shaft portion, and a tip end portion being a portion that extends from the intermediate portion and being thinner than the main shaft portion, the lock member is provided to the housing so as to be movable in an axial direction, and at least the tip end portion and the intermediate portion are disposed outside the housing, wherein the intermediate portion is configured to be narrow from the main shaft portion side toward the tip end portion side and the intermediate portion is provided with at least one inclination surface which inclines downward in a direction toward the outside of the vehicle in a width direction of the vehicle and inclines to a central axis in a direction toward the tip end portion, wherein the central axis of the tip end portion is positioned on an inner side in the width direction of the vehicle with respect to the central axis of the main shaft portion, wherein the inclination surface is disposed on an outer side in the vehicle width direction of the vehicle in the intermediate portion, wherein the intermediate portion has a flat first inclination surface and a flat second inclination surface which serve as the inclination surface, wherein the first inclination surface is provided on an upper side in a vertical direction of the vehicle and the outer side in the width direction of the vehicle, inclines downward in a direction toward the outside of the vehicle in the width direction, and inclines to the central axis of the main shaft portion in a direction toward the tip end portion, wherein the second inclination surface is provided on the inner side in the vertical direction of the vehicle and in the width direction of the vehicle and inclines downward in a direction toward the inside of the vehicle in the width direction, and wherein an inclination angle of the second inclination surface is smaller than an inclination angle of the first inclination surface.

6. The lid lock device according to claim 5, wherein the intermediate portion has a flat third inclination surface and a flat fourth inclination surface, wherein the third inclination surface is provided on a lower side in the vertical direction of the vehicle and the outer side in the width direction of the vehicle, inclines upward in a direction toward the outside of the vehicle in the width direction, and inclines in the direction to the central axis of the main shaft portion toward the tip end portion, and wherein the fourth inclination surface is provided on the lower side in the vertical direction of the vehicle and the inner side in the width direction of the vehicle and inclines upward in a direction toward the inside of the vehicle in the width direction.

7. The lid lock device according to claim 6, wherein the first inclination surface and the third inclination surface have a vertically symmetrical structure, and the second inclination surface and the fourth inclination surface have a vertically symmetrical structure.

* * * * *